United States Patent [19]

Marino

[11] 4,438,587

[45] Mar. 27, 1984

[54] BLOWGUN TOY CAR LAUNCHER

[75] Inventor: Joseph A. Marino, Whitehouse, N.J.

[73] Assignee: Arco Industries Ltd., Hong Kong, Hong Kong

[21] Appl. No.: 444,677

[22] Filed: Nov. 26, 1982

[51] Int. Cl.[3] ..... A63H 29/16

[52] U.S. Cl. ..... 46/44; 46/202

[58] Field of Search ..... 46/44, 206, 202, 6; 124/62, 64; 273/129 AP, 86 D, 85 H

[56] References Cited

U.S. PATENT DOCUMENTS

| | | | |
|---|---|---|---|
| 2,820,321 | 1/1958 | Kuhn | 46/44 X |
| 2,993,297 | 7/1961 | Bednar et al. | 46/44 X |
| 3,038,725 | 6/1962 | Stewart et al. | 273/129 AP |
| 3,621,607 | 11/1971 | Morrison et al. | 46/206 |
| 3,740,896 | 6/1973 | Glass et al. | 46/206 |
| 3,936,053 | 2/1976 | Goldfarb et al. | 273/108 |
| 4,076,006 | 2/1978 | Breslow et al. | 46/44 X |
| 4,159,705 | 7/1979 | Jacoby | 124/63 |

*Primary Examiner*—Mickey Yu
*Attorney, Agent, or Firm*—C. Hercus Just

[57] ABSTRACT

A toy car launcher provided with a base having a flat bottom surface of limited area to be placed upon a horizontal supporting surface, the base having a mouthpiece blowing tube extending upward and outward from one end portion of the base and a launching tube extending outward from the opposite end of the base in parallel with the flat bottom surface of the base and spaced a predetermined distance above the plane of the bottom surface to slidably coengage a complementary tube longitudinally in the body of a toy car and closed at the inner end, and the car body having wheels freely rotatable thereon, whereby when gas under pressure, such as human breath, is discharged into the mouthpiece blowing tube it passes into the closed end tube in the car and blasts the car from the launching tube for rolling movement along the supporting surface in front of the launcher.

6 Claims, 6 Drawing Figures

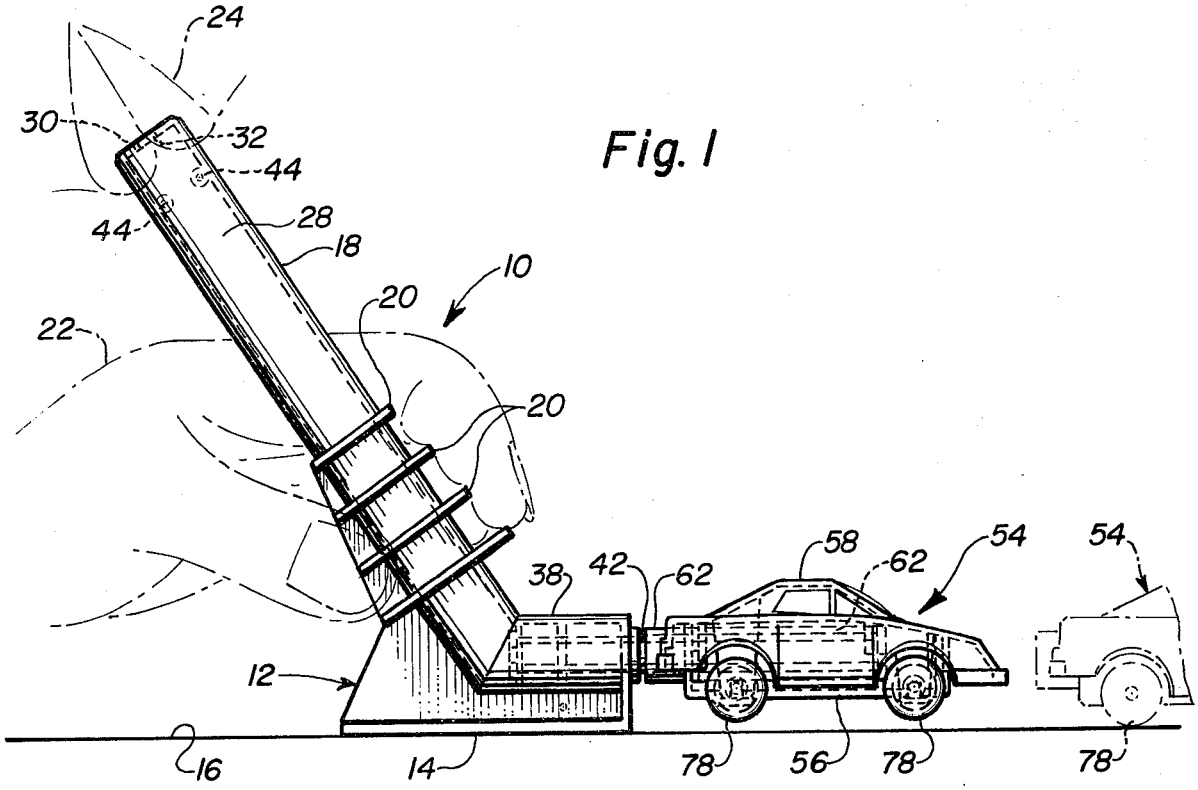
Fig. 1
Fig. 2
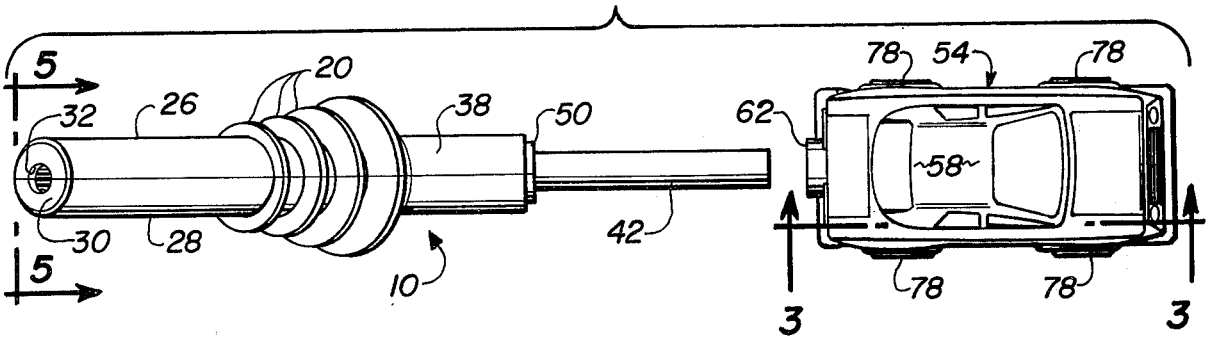
Fig. 3
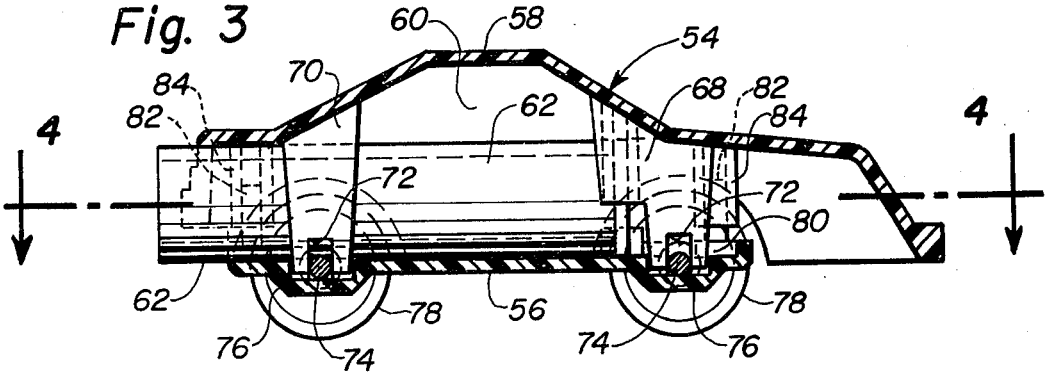

Fig. 4
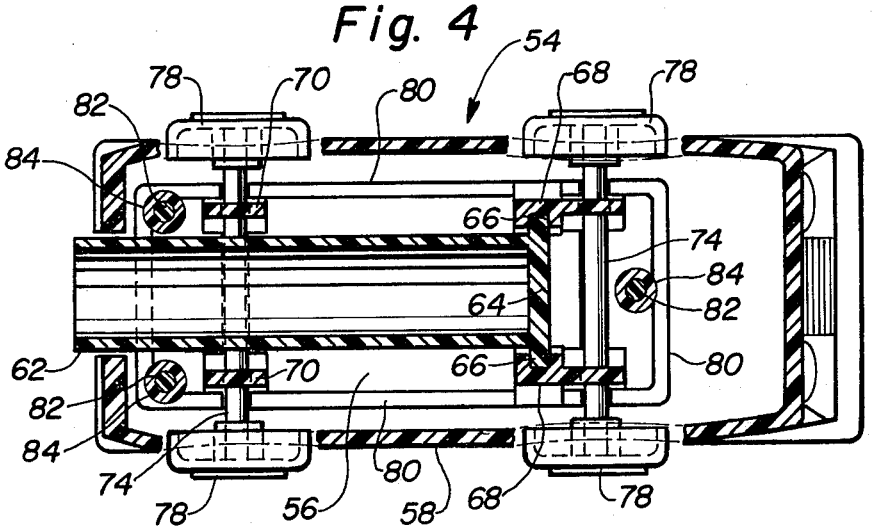
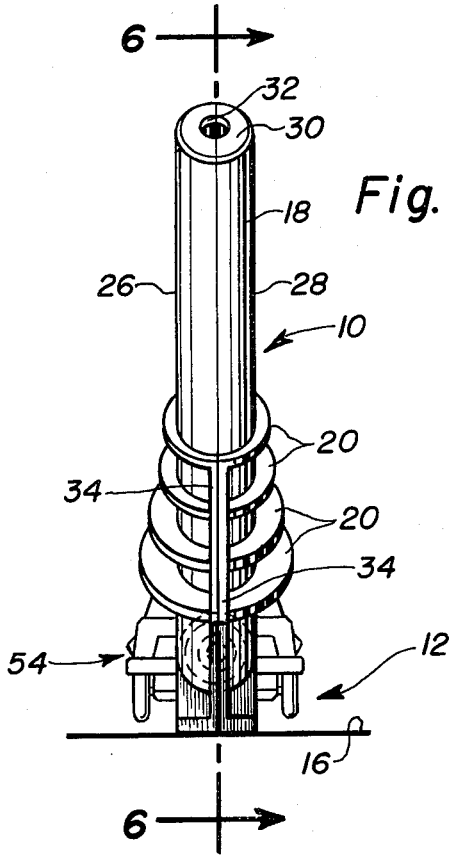
Fig. 5
Fig. 6
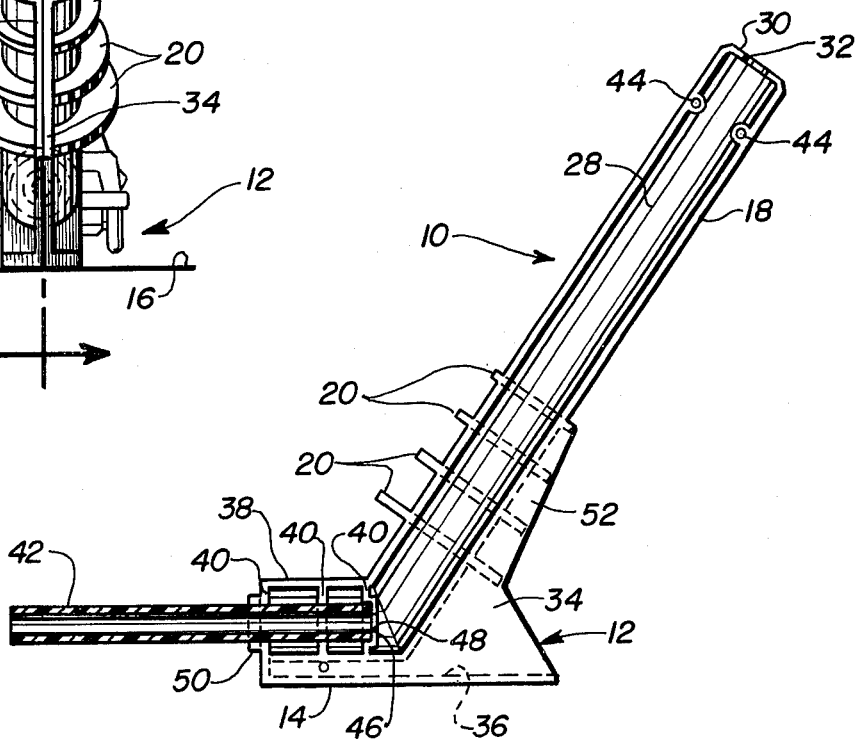

BLOWGUN TOY CAR LAUNCHER

BACKGROUND OF THE INVENTION

The present invention pertains to a toy car launcher which employs a simulated blowgun to launch a light weight toy along a supporting surface. The idea of launching toys by means of blow guns is old in many respects. Various types of toy gliders and simulated aeroplanes have been developed heretofore for launching from blow pipes and similar structures simply by a human being blowing air through the tube into the glider body and shooting it from the tube. One typical example is illustrated in prior U.S. Pat. No. 2,820,321 to Kuhn, dated Jan. 21, 1958. There are a number of other similar patents of which this is typical. In addition, launching a projectile with fins or the like from one end of a tube to which a compressible bulb is connected by a flexible hose to the launching tube comprises the subject matter of another prior U.S. Pat. No. 2,993,297 to Bednar et al, dated July 25, 1961. Also, prior U.S. Pat. No. 4,076,006 to Breslow et al, dated Feb. 28, 1978, shows a simple foot-actuated type of projectile launching device in which a depressable bulb can be stepped upon by a human foot to shoot compressed air into a short tube on the other end of which a foam plastic type projectile is telescopically mounted and from which it is shot by compressed air.

It also is old to project bullet-like projectiles from a tube by means of compressed air generated by a hand-held bulb which may be squeezed to pump air into an inflatable ballonlike member in which air is compressed and retained by a reciprocating valve which may be opened by suction from the hand-held bulb to permit the compressed air in the expansible balloon to shoot the projectile from a tube. See U.S. Pat. No. 4,159,705 to Jacoby.

It also is old to employ compressed air to project wheeled toys from suitable supports, the air being compressed by a single stroke of a pump. In this regard, prior U.S. Pat. No. 3,740,896 to Glass et al, dated June 26, 1973 illustrates a wheeled toy in which a body of liquid is contained and latch means secure one end of the vehicle to the lower end of a vertical pump which is operated to introduce air under pressure into the body of the wheeled toy and, upon releasing the latch, the air is discharged from the toy in jet manner to propel it along a surface of some type.

Prior U.S. Pat. No. 3,936,053 to Goldfarb et al, dated Feb. 3, 1976 likewise employs compressed air developed by a pump to operate an ejector member pivotally supported in a base from which a launching rack extends and a wheeled toy has a friction plug inserted in a socket and is adapted to be engaged by an ejector head on the ejector member in a manner to overcome the friction of the plug and project the wheeled toy forwardly from the rack in a guided manner determined by sighting means on the rack.

Pneumatic means also have been employed in regard to toy cars such as by utilizing both pressure and suction generated by a compressible bellows for purposes of steering a toy car and thus providing remote controls for the same, such structure comprising the subject matter of prior U.S. Pat. No. 3,513,658 to Okuma, dated May 26, 1970.

The present invention utilizes a blow gun principle in a very simple manner for purposes of launching preferably small, lightweight toy cars by very simple means which differ in principle and construction from the prior art cited and discussed above, details of the improvements afforded by the present invention being set forth below.

SUMMARY OF THE INVENTION

It is among the principal objects of the present invention to provide a preferably simple and lightweight launching device for toy cars which are projectible from the launching device by the use of human breath, designated air hereinafter.

It is another object of the invention to provide a launching device preferably molded inexpensively from rigid plastic material in a form to provide a base having a planar bottom surface adapted to be manually held upon a flat supporting surface such as a floor, table or otherwise, and the base has a mouthpiece tube extending upwardly and rearwardly from the base member, and a launching tube extending forwardly from the base member on an axis which is substantially parallel to but spaced above the flat bottom surface of the base, the launching tube communicating through the base with the mouthpiece tube so as to receive air therefrom, and a toy car which also preferably is molded from rigid plastic material has a tubular means disposed within the body and opening to the rear, said tubular means being complimentary to the launching tube on the base so as to receive air from the mouthpiece tube and projected into the car to propel the car forwardly from the launching tube, the inner end of the tubular means in the car being closed.

A further object of the invention ancillary to the immediate foregoing object is to provide the toy car with wheels that are freely rotatable relative to the body of the car so as to offer no impedence to forward rolling of the car upon a supporting surface after it is launched from the launching tube of the base and, further to render the launching highly efficient for substantial travel of the car, the position of the launching tube on the base is so arranged that when the toy car is mounted on the launching tube the wheels are disposed within a plane parallel to the flat bottom of the base, the plane in which the wheels are disposed will be spaced from the plane of the bottom of the base as well as the supporting surface upon which the toy car is to roll, whereby during the normal shooting of the car from the launcher, all wheels of the car will not engage the supporting surface until it is at least a certain distance forwardly from the launching tube and thereby permit the cars to roll for a substantial distance along the supporting surface.

Still another object of the invention is to adapt the toy car launcher and the cars projected thereby competitive in nature in that one launcher and car may be colored the same color and another launcher and car may be colored a different color from the first pair, whereby competition between two players may ensue in accordance with the spirit of the invention, coupled with the fact that a plurality of cars may be provided for each launcher, all colored the same as the launcher and several sets of launchers and respectively colored plurality of cars may be provided in a total game that can be merchandised.

One further object of the invention is to facilitate the holding of the base member upon a supporting surface by the use of manually-engageable gripping means formed either on the base and/or the mouthpiece tube, not only for firmly securing the base upon a supporting surface but also in assisting in aiming the launching tube as desired, with respect to a target or otherwise.

Details of the foregoing objects and of the invention, as well as other objects thereof, are set forth in the following specification and illustrated in the accompanying drawings comprising a part thereof.

BRIEF DESCRIPTION OF THE DRAWINGS

FIG. 1 is an exemplary side elevation of a toy car launcher supported in operative position upon a supporting surface and upon which, in solid lines, a toy car is positioned for launching while in phantom, fragmentarily, a portion of the launched car is illustrated and also in phantom, the manner in which the launcher is supported upon the supporting surface is illustrated.

FIG. 2 is a top plan view of the launcher and toy car shown in FIG. 1 but illustrated in exploded manner with the car separated from the launching tube.

FIG. 3 is an enlarged vertical section view of an exemplary toy car such as illustrated in FIGS. 1 and 2 and showing tubular means within the body of the toy car.

FIG. 4 is a horizontal sectional view of the car shown in FIG. 3 as seen on the line 4—4 thereof.

FIG. 5 is a rear end vertical elevation of the toy car launcher per se as seen on the line 5—5 of FIG. 2.

FIG. 6 is a vertical sectional view of the launcher per se as shown in FIG. 5, as seen on the line 6—6 thereof.

DETAILED DESCRIPTION OF THE PREFERRED EMBODIMENT OF THE INVENTION

Referring to the drawings and particularly FIG. 1, it will be seen that the toy car launcher 10 comprises a base 12 provided with a flat bottom surface 14 of reasonable area to afford firm support for the base 12 upon a flat supporting surface 16 such as a table, floor or otherwise. The base 12 also has an integral mouthpiece tube 18 which extends preferably upwardly and rearwardly from the base 12 at an acute angle to the supporting surface 16, as clearly shown in FIG. 1.

To facilitate firmly holding the base 12 and the bottom surface 14 flatly upon the supporting surface 16, the base and/or the mouthpiece tube 18 are provided with a series of transverse, circular flanges 20 which are engageable by the thumb and finger of the hand 22 of a person operating the toy car launcher such as by applying the lips 24 to the outer end of the mouthpiece tube 18 and blowing a blast of air into it.

The toy car launcher 10 preferably is manufactured readily and inexpensively by being formed of two molded sections or sides 26 and 28, one of which is shown in side elevation in FIG. 6. From said figure, it will be seen that the interior of the selected section 28 is hollow and the upper end terminates in the transverse flange 30 having an inlet opening 32 for the ingress of human breath. The flanges 20 also are molded integrally with the section of the mouthpiece tube 18, together with a thin web 34 which extends partially along the tube 18 and, together with the web 34 of the opposite section 26 comprises part of the base 12. Each of the thin webs 34 terminate in a laterally extending flange 36 which provide the flat bottom surface 14. The forward portion 38 of the base 12 is provided on the interior with a series of transverse flanges 40 which each have semicircular openings, whereby when the two sections 26 and 28 are connected, the openings in said flanges form circular holes to receive the inner end of a launching tube 42 which also preferably is molded from rigid plastic material of uniform diameter, it also being understood that the material may be similar to that from which the sections 26 and 28 of the launcher 10 are formed such as by injection molding. Suitable connecting means 44 such as sockets and pins, as well as cement, are employed to connect the sections 26 and 28 to each other to form the completed launcher 10.

Referring to FIG. 6 in particular, it will be seen that the forward portion 38 of each of the sections 26 and 28 also are provided with an inner end flange 46 having an opening 48 comprising an air passage to direct air, such as human breath, blown into the mouthpiece tube 18 to be transmitted to the launching tube 42. A reinforcing collar 50 also adjoins the outermost transverse flanges 40 and comprises part of the supporting means for the launching tube 42. Otherwise, the interior of the launching tube 18 is hollow for its entire length and at the lower inner end immediately adjoins the forward portion 38 of the base 12. The upwardly extending portion 52 of the thin web 34 of each of the sections 26 and 28 form adequate bracing means for the mouthpiece tube 18 with respect to base 12.

The purpose of the toy launcher 10 is to support and project a toy car 54 from the launching tube 42. The car 54 is preferably molded from rigid synthetic resin or plastic material and in the preferred construction, comprises a bottom member 56 and an upper member 58. The car is preferably very light in weight to facilitate travel thereof when launched from the tube 42. It also is to be noted that the tube 42, as best shown in FIG. 6, preferably is parallel to the bottom surface 14 of base 12 and the axis of the tube is spaced above the bottom surface 14. The reason for this is explained below.

The interior of the car 54 is hollow and comprises a cavity 60 which accommodates a tube 62 which, as best seen from FIG. 4, has a transverse closure 64 at the inner end which is provided with short oppositely extending flanges 66 which are received in complimentary grooves in thin downwardly extending posts 68 formed integrally with the upper member 58 incident to being molded. Additional posts 70 also extend downwardly from the upper member 58 as best shown in FIG. 3 and all of the posts 68 and 70 have upwardly extending notches 72 formed in the lower ends thereof as seen in FIG. 3 for purposes of receiving transverse axles 74 preferably in relatively loose manner so as to provide very free rotation of the axles 74 within the notches 72 and not impede rotation thereof. The axles are retained within the notches 72 by coacting portions 76 of the bottom member 56 which form closures for the lower ends of notch 72 as clearly seen in FIG. 3. The opposite ends of the axles respectively receive by press fit similar wheels 78 and especially from FIG. 4, it will be seen that the hubs of the wheels 78 are spaced from side flanges 80 which are integral with and extend upward from the bottom member 56 whereby, in conjunction with the relatively free mounting of the axles within the notches 72, facilitate free rotation of the wheels and axles for purposes described immediately below. The bottom and upper members 56 and 58 also are readily connected together by means of pins 82 being molded integrally with the bottom member 56 and sockets 84 being mounted integrally with the upper member 58. The pins and sockets may be secured by suitable cement or friction fit.

The car 54 is supported upon the launching tube 42 by disposing the tube 62 thereon telescopically, the inner diameter of tube 62 being only slightly greater than the outer diameter of tube 42. As shown in FIG. 1, the car 54 extends substantially for the full length of the launching tube 42 in the preferred construction but this is not to be considered restrictive. Further, and very importantly, it will be seen that in the otherwise preferred construction, the axis of the launching tube 42 is sufficiently spaced above the supporting surface 16 that when the car 54 is mounted on tube 42, the lower surfaces of the wheels 78 are disposed within a plane preferably parallel to but spaced a limited distance above the supporting surface 16 so as not to interfere with the initial projection of the car 54 from the launching tube 42 by means of air such as human breath being blown under pressure into the mouthpiece tube 18 and through the launching tube 42. Due to the preferred relatively free rotation of the wheels 78 with respect to the car 54, it will be seen that when the car leaves the launching tube 42 as shown in phantom in FIG. 1, it is free to move on the rotating wheels for substantial distances, depending upon the amount and force of the breath injected into the mouthpiece tube 18.

In operating as well as merchandising the present invention, it is contemplated that a plurality of the toy car launchers 10 can be provided in a package together with a plurality of toy cars. For example, a set comprising a launcher and toy car may be colored similarly, while a second set of launcher and car may also be colored similarly but a different color from that of the first set. By such means, a plurality of players respectively can select a launcher and car and compete in launching the cars and determining the distances traveled or targets engaged by the projected cars and thereby provide amusement and competition in the form of a game or otherwise. Further, several cars of the same color as the launcher may be provided for each launcher so as to permit successive launchings before retrieval of the cars is necessary.

From the foregoing, it will be seen that the present invention provides a simple but very enjoyable toy in the form of a launcher for a toy car by means of blowing human breath into the launcher to discharge the car from the forward end of the launching tube of the launcher. The toy is entirely safe and free from the possibility of injuring either the players or observers. Means are provided for firmly holding the launcher flatly upon a supporting surface by manual means and thereby insure that the toy car will be disposed as intended upon the launching tube 42 to insure maximum efficiency in launching the toy car to provide the greatest distances of travel therefor.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A blowgun toy car launcher and car comprising in combination, a. a base having a bottom surface arranged to be disposed and manually held preferably upon a horizontal supporting surface, b. a mouthpiece tube extending from said base at an upwardly and rearwardly extending angle and having an outer end adapted to be engaged by the mouth of a person so as to blow air into said tube and launch said toy car, c. a launching tube extending forwardly from said base and lower end of said mouthpiece tube and having an outer end directed away from said mouthpiece tube and in an opposite direction from said tube, d. air-conducting means within said base extending between and communicating with the ends of said tubes which are connected to said base to establish a through passage between said outer ends of said mouthpiece tube and launching tube, e. a toy car having front and rear ends and freely rotatable wheels thereon, and f. a longitudinal cavity in said car closed at the forward end thereof and opening to the rear end thereof and generally complementary in shape to at least the outer end of said launching tube and adapted to slidably coengage the exterior of said launching tube for support thereby and projection therefrom, whereby when said mouthpiece tube has air blown into it under pressure said air will act against the closed forward end of said longitudinal cavity in said toy car to project said car from said launching tube for rolling movement along said supporting surface.

2. The toy car launcher according to claim 1 in which said cavity is in the form of a straight tube positioned longitudinally in said car and complementary to said launching tube for relatively free telescopic movement therebetween.

3. The toy car launcher according to claim 2 in which said tube in said car is adapted to be mounted upon the exterior of said launching tube.

4. The toy car launcher according to claim 1 in which said supporting surface of said base is flat and of sufficient area to provide firm support for said base when manually pressed against a supporting surface to position the launching tube in a manner to be at least substantially parallel to said supporting surface, and manually engageable means adjacent said base adapted to facilitate manually pressing said base against said supporting surface.

5. The toy car launcher according to claim 4 in which said mouthpiece tube extends at an acute angle to the bottom surface of said base, and said manually-engageable means comprising projections on said mouthpiece tube adjacent said base.

6. The toy car launcher according to claim 1 in which said bottom surface is planar and the axis of said launching tube is at least substantially parallel to said bottom surface, and the axis of said launching tube being spaced from the plane of said planar bottom surface sufficiently that when said toy car is supported upon said launching tube the wheels of said car are in a plane parallel to said supporting surface with said wheels being out of contact with said supporting surface and thereby facilitate launching said car with maximum efficiency.

* * * * *